United States Patent [19]

Wakai

[11] 4,398,834

[45] Aug. 16, 1983

[54] ELECTRONIC WATCH WITH DEMONSTRATION DISPLAY MODE

[75] Inventor: Youichi Wakai, Suwa, Japan

[73] Assignee: Kabushiki Kaisha Suwa Seikosha, Tokyo, Japan

[21] Appl. No.: 344,121

[22] Filed: Jan. 28, 1982

Related U.S. Application Data

[63] Continuation-in-part of Ser. No. 158,752, Jun. 12, 1980.

[30] Foreign Application Priority Data

Jun. 12, 1979 [JP] Japan ..... 54-73733

[51] Int. Cl.[3] ..... G04B 19/00; G04B 25/00

[52] U.S. Cl. ..... 368/223; 368/82

[58] Field of Search ..... 368/82, 83, 84, 87, 368/73, 74, 70, 72, 185–189, 250, 251

[56] References Cited

U.S. PATENT DOCUMENTS 4,063,409 12/1977 Bayliss ..... 368/84

4,115,993 9/1978 Moriya ..... 368/72

4,250,523 2/1981 Murata ..... 368/84

OTHER PUBLICATIONS

IBM Tech. Disc. Bulletin "Multiple Output Function for an Electronic Watch" vol. 16, #4, Sep. 1973, pp. 1296, 1297.

*Primary Examiner*—Bernard Roskoski

[57] ABSTRACT

A demonstration function is included in an electronic watch capable of displaying the plurality of functional modes of the watch, which modes are subject to setting and correction by selective operation of a plurality of external members. The demonstration mode, induced by a selected operation of external members, displays in automatic sequence every function of the watch. Concurrently with the automatic, sequenced display of functions, display markers are visible indicating which external members need be operated to manually and independently produce each displayed function. Accordingly, the watch demonstrates and teaches its own operation and capabilities.

7 Claims, 7 Drawing Figures

FIG. 1
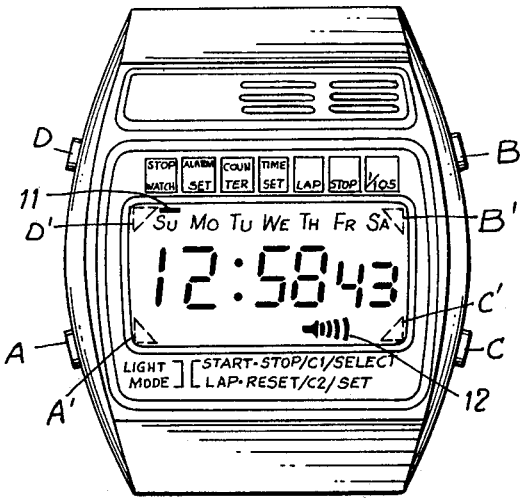
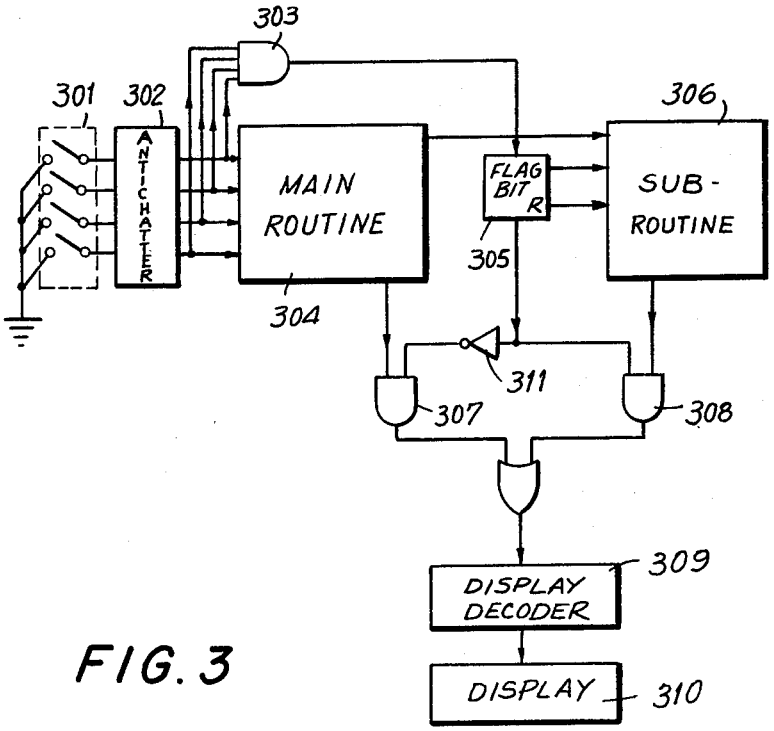
FIG. 3

200
201
202
203
210
211
212
213
214
215
220
221
222
223
224
230
231
232
233
240
241
STOP WATCH
ALARM SET
COUNTER
TIME SET
REPEAT TO SELECT HOUR AND MINUTE
B TWICE
C ONCE
B.C
MINUTE
HOUR
DATE
MONTH
SECOND RESET

ELECTRONIC WATCH WITH DEMONSTRATION DISPLAY MODE

BACKGROUND OF THE INVENTION

This application is a continuation-in-part of application Ser. No. 158,752 filed June 12, 1980, for Electronic Watch.

This invention relates to a digital electronic watch using optical display elements in a display unit and particularly to an electronic watch capable of performing a plurality of functions and having a demonstration function to show and teach the operations of the timepiece. Recently, two types of wristwaches dominated the markets for such timepieces. Namely, these dominant types are analog watches having hands to indicate the functions of timekeeping and digital watches having numeral displays to indicate timekeeping and other functions. The digital watches, especially digital electronic watches having liquid crystals or the like display units, not only indicate normal timekeeping functions but also include supplemental functions such as a stopwatch, alarm, counter and substracting timer functions. Such multifunctional timepieces are extremely practical. However, in order to make full use of the plurality of functions, external switches, for example of the button type, have to be properly operated. Accordingly, difficulties in operation of these multifunctional digital timepieces are much greater than those in operating the conventional analog watch.

Therefore, a watch users need to have a lecture on the manner of operating the timepiece when they buy the watch. Thereafter, they generally have to read accompanying instruction manuals to reliably and positively learn how to operate the watches. When there are a large number of functional modes of watch operation, it takes considerable time for the user to freely operate the watch without consultation with the instruction manual. Further, it is generally accepted that an increasing number of functions are to be added to digital watches in the future.

What is needed is a multi-functional electronic watch which is capable of demonstrating all of its functions in a simple manner and which teaches its operation to the user without the need for extended instruction and manuals.

SUMMARY OF THE INVENTION

Generally speaking, in accordance with the invention, an electronic timepiece which teaches its own use and demonstrates its capabilities is provided. The electronic watch is capable of performing a plurality of functions and is subject to setting and correction by selective operation of a plurality of external members. A demonstration mode, induced by a selective operation of external members, displays in automatic sequence every function of the watch. Concurrently with the automatic, sequenced display of functions, display markers are visible indicating which external members need to be operated to manually and independently produce each display function. Accordingly, the watch demonstrates and teaches its own operation and capabilities.

The user can confirm the functions of the watch at any time by a single proper operation of the external members or switches. The display markers appear physically adjacent to the same external members which need be operated to manually and independently produce the displayed function.

Accordingly, it is an object of this invention to provide an improved electronic watch having a demonstration function which automatically demonstrates every function of which the watch is capable.

Another object of this invention is to provide an improved electronic watch which demonstrates every function of which it is capable and provides display markers indicating which external members need be operated to produce the displayed function independently and manually.

A further object of this invention is to provide an improved electronic watch which a user can operate to the full extent of its capabilities without reliance on extensive and complicated instruction manuals.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a front elevational view of a digital watch in accordance with the present invention;

FIG. 3 is a functional block diagram of the circuits of the watch of FIG. 1;

DESCRIPTION OF THE PREFERRED EMBODIMENTS

An electronic watch in accordance with this invention is operated to perform a plurality of functions by means of external switches. A display panel, for example, a liquid crystal display, includes markers adjacent to the positions of the external switches. In a demonstrating mode of operation, the marker adjacent to the switch which is to be operated to produce a demonstrated function is displayed. The demonstrating mode of operation teaches a user of the watch which function is associated with which switch.

A digital watch having a plurality of functions is shown in FIG. 1 as an example of a multi-functional watch in accordance with this invention. The watch includes a liquid crystal display and provides in addition to the timekeeping functions a stopwatch function, an alarm function, a counter (binary) function, and additional functions as described hereinafter. The timepiece is provided with four external members or switches, A, B, C, D. The switch A is used for mode changing. The switch B is used for selecting a month and a day. The switch B is also used to effect the start and stop in the stopwatch mode, and for effecting a count-up and digit selection in the counter mode. A button switch C is used for setting an alarm time, for effecting a lap measurement and reset in a stopwatch mode of operation, for causing a count-up in a counter mode, and for setting a digit. The button switch D is used for lighting a lamp to illuminate the display.

The display of the watch of FIG. 1 is a conventional time display showing hours, minutes, seconds, days of the week, etc. Display markers A', B', C' and D' on the display are adjacent to the switches A, B, C and D respectively and are used only in a function demonstrating mode of operation as explained more fully hereinafter. Normally, the display markers A', B', C' and D' are in an invisible, that is, non-contrasting condition. A bar indicator 11 is positioned to identify the present day and for identifying functional modes other than timekeeping modes. An alarm sounding mark 12 also appears on the display of FIG. 1.

Figure 2:
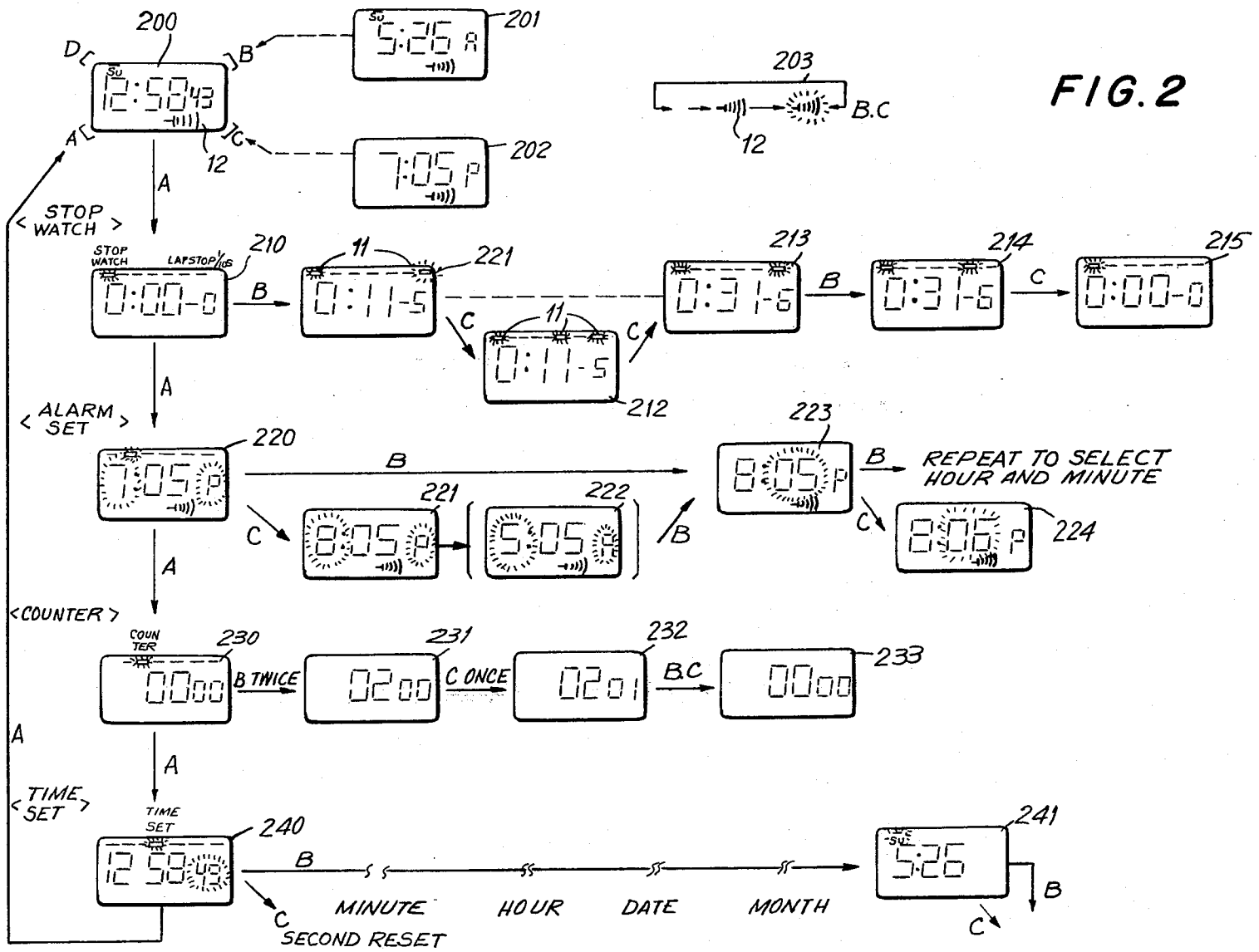
FIG. 2 is a diagram showing the functions and operations of the watch of FIG. 1.

The functions of the timepiece of FIG. 1 and the methods of operation are described in particular with reference to FIG. 2. It should understood that the displays of FIGS. 1 and 2 serve as an example in describing this invention and other displays and functions can be used in conjunction with the invention. The watch illustrated in FIG. 1 is known as model X, manufactured by the Seiko Company of Japan.

With reference to FIG. 2, a normal time display mode 200 includes a display of hours, minutes, seconds and day. When the button switch B is actuated, that is turned on under this condition 200, the month and date are selected for display 201. When in condition 200, the button switch C is turned on, the time for sounding an alarm is displayed 202. The alarm sound marker 12 in condition 200 indicates that an alarm time is set. This time is 7:05 PM. When in the normal time display mode 200, the switches B and C are simultaneously operated, the alarm marker 12 is repeatedly lit, unlit and flashing so as to indicate conditions under which neither the alarm nor the correct time are sounded, or a condition where only the alarm is sounded, or the condition where both the alarm and correct time can be sounded.

When the switch A is actuated with the timepiece in the normal time display mode 200, the display shifts to a stopwatch mode 210. Then, when the switch B is actuated in the mode 210, a stopwatch display 211 begins. Indicators 11 corresponding to the characters STOP WATCH and "1/10s" flash to indicate that this is the condition of operation of the timepiece of FIG. 1. These identifications, for example, STOP WATCH are printed on the liquid crystal panel cover. A lap time is displayed 212 when the switch C is actuated while the display is in the stopwatch mode 211. Also, the lap indicator 11 flashes. When the switch C is again actuated, the display ceases to indicate the lap time and returns to continue to display time measurement 213. Then, when switch B is actuated, the stopwatch function is stopped 214. Actuation of switch C then returns the display to the zero condition 215 which corresponds with the condition 210.

When the display is in the stopwatch mode 210 and switch A is actuated, an alarm time setting mode 220 is effected. First, the hour digit, that is, "7" in the mode 220, flashes to indicate that the hour digit can be corrected. Then, every time switch C is actuated, the hour digit advances one hour 221 and corrections of the hour of large magnitude can be quickly effected by maintaining the switch C in a continuously on condition 222. The letters A or P flash on the display to indicate AM and PM respectively. When in the modes 220, 221, 222, switch B is actuated, the hour digit stops flashing and the minute digits begin to flash to indicate that the minute digit correction can now be accomplished 223, 224. Every time the switch B is actuated, the hour digit and minute digit are repeatedly and alternately selected for setting.

When the switch A is actuated while the display is in the alarm set mode 220, the minute and ten minute digits are advanced by actuating the switch B. One actuation of the switch B produces an advance of one unit whereas two actuations of the switch B in the mode 231 advances the minute digits by two units. Two digits are devoted to display seconds and the count of seconds is advanced by one unit by actuating the switch C as indicated at 232. The display is returned to the zero condition 233, 230 by simultaneously actuating both switches B and C.

When the display is in the mode 230 and switch A is again actuated, a time correcting mode is produced and displayed 240. Initially, the portion of the display showing seconds of time flashes to inform the user that the timepiece is in the second correcting position. When the switch C is actuated, the two seconds digits are returned to zero. Then, when the switch B is actuated, the digits on the display indicating the minutes flash and they are corrected by actuation of the switch C. The next actuation of the switch B causes the hour digits to flash and they can be corrected by an operation of the switch C. The date, month and day are also brought into a flashing condition and can be corrected by the same sequence of actuations of switches B and C. The method for correcting digits higher than the ten minute digit is similar to the method used in correcting the hour digit and the alarm time set mode described above.

In summary, the watch at FIG. 1 has its displayed functions successively changed by actuating the switch A. In the watch in accordance with this invention, another mode of display, that is a demonstrating mode, is initiated by simultaneously actuating the switches A, B, C and D. A functional block diagram of the circuit for effecting the normal functional modes of operation and the demonstration function is generally shown in FIG. 3. The switches A, B, C, and D are shown in the grouping 301. A main routine circuit 304 receives the signals from the switches 301 and creates the conditions which allow for the performance and display of the normal functions from the time display mode to the time correcting mode as described above. A subroutine circuit 306 is used to effect the demonstration mode or function. In the demonstration mode, signals from the subroutine circuit 306 are fed to a display decoder 309 through an AND gate 308. The signals from the display decoder 309 actuates a display 310 as described hereinafter. The main routine circuit 304 also feeds signals to the display decoder 309 and display 310 by way of the AND gate 307. Which of the two sets of signals, that is, routine or subroutine, are to be inputted to the display decoder 309 is determined by the logic level of a flag bit 305 which provides a high or a low input to AND gates 307 and 308. An inverter 311 between the flag bit circuit 305 and AND gate 307 assures that only one of the gates 307, 308 is enabled to pass signals at a given moment. When the output of the flag bit circuit 305 is high, signals from the subroutine circuit 306 pass through the AND gate 308 and are fed to the display decoder 309. When the signal out of the flag bit circuit 305 is low, the AND gate 308 is blocked and the main routine circuit 304 passes signals through the gate 307 to the display decoder 309.

Under normal operating conditions, by selectively operating the respective switches A, B, C, and D (FIG. 1), data from the main routine circuit 304 is fed through the AND gate 307 because the flag bit circuit 305 is inputted a low output of an AND gate 303. The low input to the flag bit circuit 305 results in a low output signal from the flag bit circuit 305. Thus, the normal functional modes are normally displayed by the display unit 310 since none of the operations described above in relation to FIG. 2 require that all four switches be actuated simultaneously. Only simultaneous actuation of the four switches 301 causes the AND gate 303 to go high at its output and produce a high output from the flag bit circuit 305.

When all of the switches 301 are actuated, that is closed, the output of the AND gate 303 reaches a high level after the switch signals pass through an anti-chatter circuit 302. This high from the AND gate 303 inverts the content of the flag bit circuit 305 such that the data fed to the display decoder 309 is introduced from the subroutine circuit 306. Thus, when the content of the flag bit circuit 305 goes high, demonstration mode signals D MODE are transferred from the flag bit circuit 305 to the subroutine circuit 306 to thereby initiate the subroutine.

Figure 4:
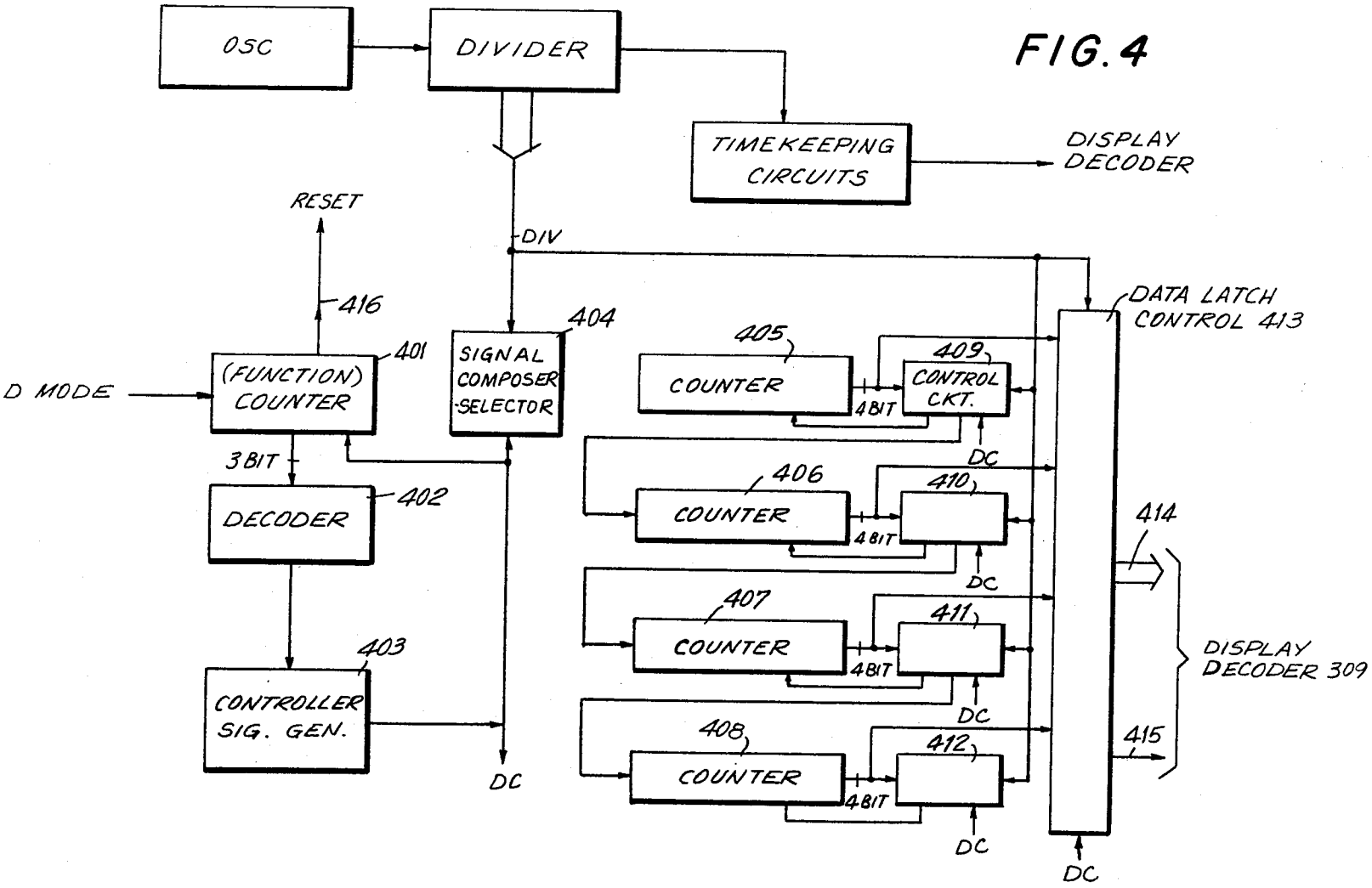
FIG. 4 is a more detailed block diagram of a portion of the circuit of FIG. 3.

The subroutine circuit 306 is shown in FIG. 4. A counter 401 counts the various functional conditions, for example, stopwatch, counter, etc. in the demonstration mode. The counter 401 is a three bit counter for feeding information of three bits to a decoder 402 in which the respective modes are decoded. The counter 401 starts to count upon the input of a D MODE signal from the flag bit circuit 305. A controller 403 generates control signals DC in the demonstration mode for sucessively producing the displays as described hereinafter. Counters 405–408 are of four bit contruction which respectively correspond to one digit thereby to effect a hexal, decimal and duodecimal count.

A signal composer/selector 404 controlled by the DC signal from the controller signal generator 403, selects clock signals DIV from the frequency divider of the timepiece and inputs these signals to the counter 405. For instance, one second signals or 1/10 second signals of a stopwatch mode are transferred from the signal composer-selector 404 to the counter 405. Control circuits 409–412 operate with the counters 405–408 respectively for controlling in which notation the counters 405–408 are set, for setting or resetting the contents of the counters 405–408 thereby to set preselected conditions, and for controlling the carry-over to the subsequent counter. The control circuits 409–412 are also controlled by the DC signals from the controller signal generator 403.

Outputs of the counters 405–408 are fed to a data latch control circuit 413 which controls the data 414,415. This data 414,415 is fed to the display decoder 309 and causes the display to flash where appropriate, to display lap time and elapsed time in the stopwatch mode, to show counting functions, to light the switch segments A', B', C' and D' corresponding to the external switch members, and so on.

The displays in the demonstration mode are arbitrarily selected to illustrate typical conditions of each mode of normal operation. The same data is displayed in each sequential step respectively of the demonstration mode every time the cycle is initiated by the concurrent actuation of the four external members. The display data sequentially illustrates each mode of the timepiece operation and switch actuations required to effect such operation.

After the demonstration has been performed, signals 416 are generated by the counter 401 to reset the flag bit circuit 305. Once reset, the flag bit circuit 305 returns the watch to the normal operations are controlled by the main routine circuit 304 (FIG. 3).

Figure 6:
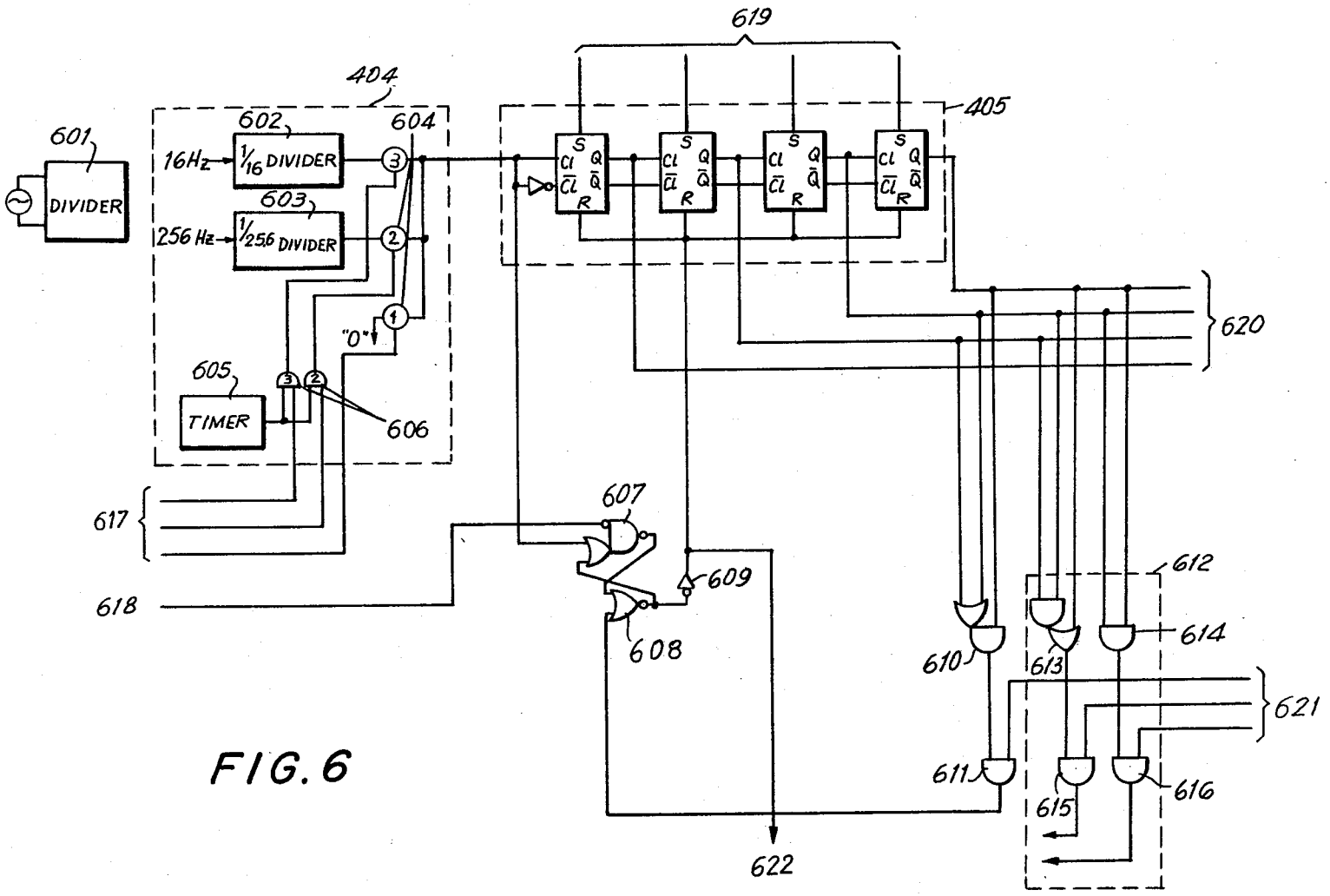
FIG. 6 is a circuit of a portion of the components in the diagram of FIG. 4.

The signal composer-selector 404, the first counter 405 and the counter control circuit 409, shown in FIG. 4, are described in greater detail with reference to FIG. 6, wherein similar functional blocks are given the same reference numeral as in FIG. 4.

Within the signal composer-selector 404, a divider 602 is inputted a 16 Hz signal from a frequency signal generating source and divider 601. In the divider 602, the inputted signal is divided by the ratio 1/16 yielding an output signal of one hertz. A second divider circuit 603 is inputted a signal from the frequency signal generator divider 601 of 256 Hz and a signal of 10 Hz is outputted as a result of a division of 1/25.6.

Selectively, either signal, that is, the 1 Hz output from the divider 602 or the 10 Hz output of the divider 603, is inputted to the counter circuit 405. A group of transmission gates 604 comprised of gates 1, 2, 3 as illustrated are interposed between the outputs of the dividers 602, 603, respectively, and the input line to the counter 405 for the purpose of selecting between outputs. A third input can also be selectively input to the counter 405 through the transmission gate 1. This third input is a signal at a low or "zero" level.

The output of an AND gate group 606 including gates 2, 3, determines which transmission gate in the group 604 is turned on and thereby determines which of the three signals is delivered from the signal composer-selector 404 to the counter 405.

DC signals 617 of three bits are generated by the controller signal generator 403 (FIG. 4) as described above. In this three bit signal, only one bit is at the high level, "one", and accordingly only one of the AND gates 606 is turned on to select one of the transmission gates in the group 604.

For example, when the timepiece is in the demonstration mode and the normal time display condition is to be demonstrated by simulation, the AND gate 3 is selected in the AND gate group 606 and the transmission gate 3 is selected in the transmission gate group 604 by a signal 617 which is high only on the line inputted to the gate 3 of group 606. In this way, a 1 Hz signal passes from the divider 602 through the transmission gate 3 of group 604 and serves as a clock input to the first stage of the counter 405.

Similarly, in the demonstration mode when the stopwatch display condition is to be demonstrated, the 10 Hz signal becomes a clock signal for the counter 105 passing a transmission gate 2 of the group 604 when the gate 2 of the group 606 receives a high input signal 617. When the transmission gate 1 of the group 604 is turned on by a high signal 617 from the controller 403, no clock signal is supplied to the counter 405 since the signal on the line to the transmission gate 1 of group 604 is at the level "zero". Thus, the normal time function is displayed with the display advancing to indicate one second increments whereas the stopwatch display is demonstrated with the display advancing in 1/10 second increments.

The time allocated for performing each display condition in the demonstration mode, said displays being normal time and stopwatch in this example, is controlled by a timer 605 within the signal composer-selector 404. When the output of the timer 605 is at a high level, and AND gate in the group 606 is turned on in conjunction with a high signal 617 from the controller 403. Thus, while the timer outputs a high signal an input clock signal is applied to the counter 405. When the output of the timer 605 is low, no clock signal is supplied to the counter 405.

The counter 405 is a binary counter formed in a four bit construction of flip-flops. The flip-flops are provided with both set and reset input terminals, and the counters 405–408 (FIG. 4) have the same construction as illustrated in FIG. 6. The output signals of the counter 405 control the lowest digit for display. In the normal time display condition of the demonstration mode, the counter 405 controls the ones digit of the display of seconds. In the stopwatch display condition of the demonstration mode, the counter 405 controls the 1/10th of a second digit. In another mode, for example, an alarm time display condition for demonstration, the counter 405 controls the ones minute digit.

At each display condition in the demonstration mode, an initial value of a digit output by the counter 405 for display is determined by a reset input 618 which is followed by a set input of a signal 619. With five bits of information 618, 619, the counter 405 is cleared and a value is inputted which appears immediately when the demonstration mode appears. That is, for example, when the normal timekeeping mode is to be displayed in simulated demonstration and appears visibly on the display, there is immediately visible, rather than a series of zeros, some time indication representative of a typical time. This time indication is then advanced in the timekeeping demonstration mode at a one second rate. It should be noted, that the initial time which appears in the demonstration of the timekeeping mode need not have any direct relationship to the actual time but is merely a preselected "time" representative of any time which could appear. Also, in demonstrating the stopwatch function, an initial value, for instance, all zeros, can be input to the counter 405 as a representative stopwatch condition which then advances to indicate 1/10ths of a second increments.

For the normal timekeeping and stopwatch functions, the counter 405 operates as a counter of decimal notation so as to control the one second digit and 1/10th second digit for the normal timekeeping and stopwatch functions respectively. A composing gate 610 detects the code 1010 (count 10) on the output lines 620 of the flip-flops, and this output of the composing gate 610 resets the counter 405 by means of a set-reset latch including a NAND gate 607, a NOR gate 608 and an inverter 609. The reset signal 618, described above for initiating a demonstration, also passes through the set-reset latch circuit. Further, an output 622 from the set-reset latch carries the digit to the next place, that is, to the second counter 406 (FIG. 4). The data output 620 of the counter 405 is transferred to a data latch control circuit 413 (FIG. 4) as described above.

The counter 405 may as well operate as a decimal counter. However, the second to the fourth counters 406–408 (FIG. 4) are required to operate by selecting a notation from hexal, decimal and duodecimal notations in accordance with the display condition. Code detecting gates 613, 614 for controlling hexal and duodecimal notations are indicated in the group 612, and AND gates 611, 615, 616 determine which notation of hexal, decimal and duodecimal is selected. This selection is made in conjunction with a three bit DC signal 621 applied to the gates 611, 615, 616.

Figure 5A:
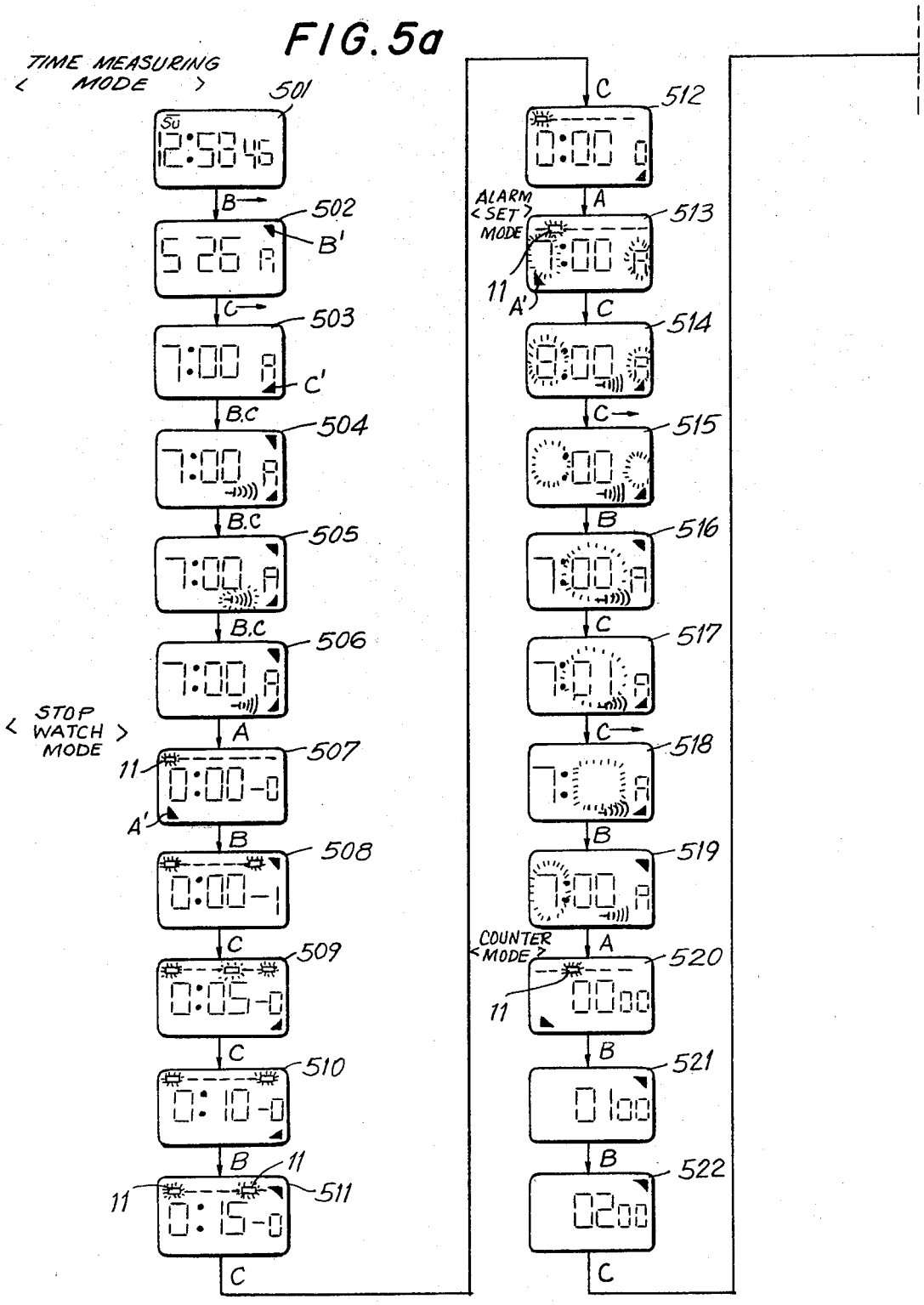
FIGS. 5A, 5B together show a sequence in the displays in a demonstrating mode of the watch of FIG. 1 in accordance with this invention.
Figure 5B:
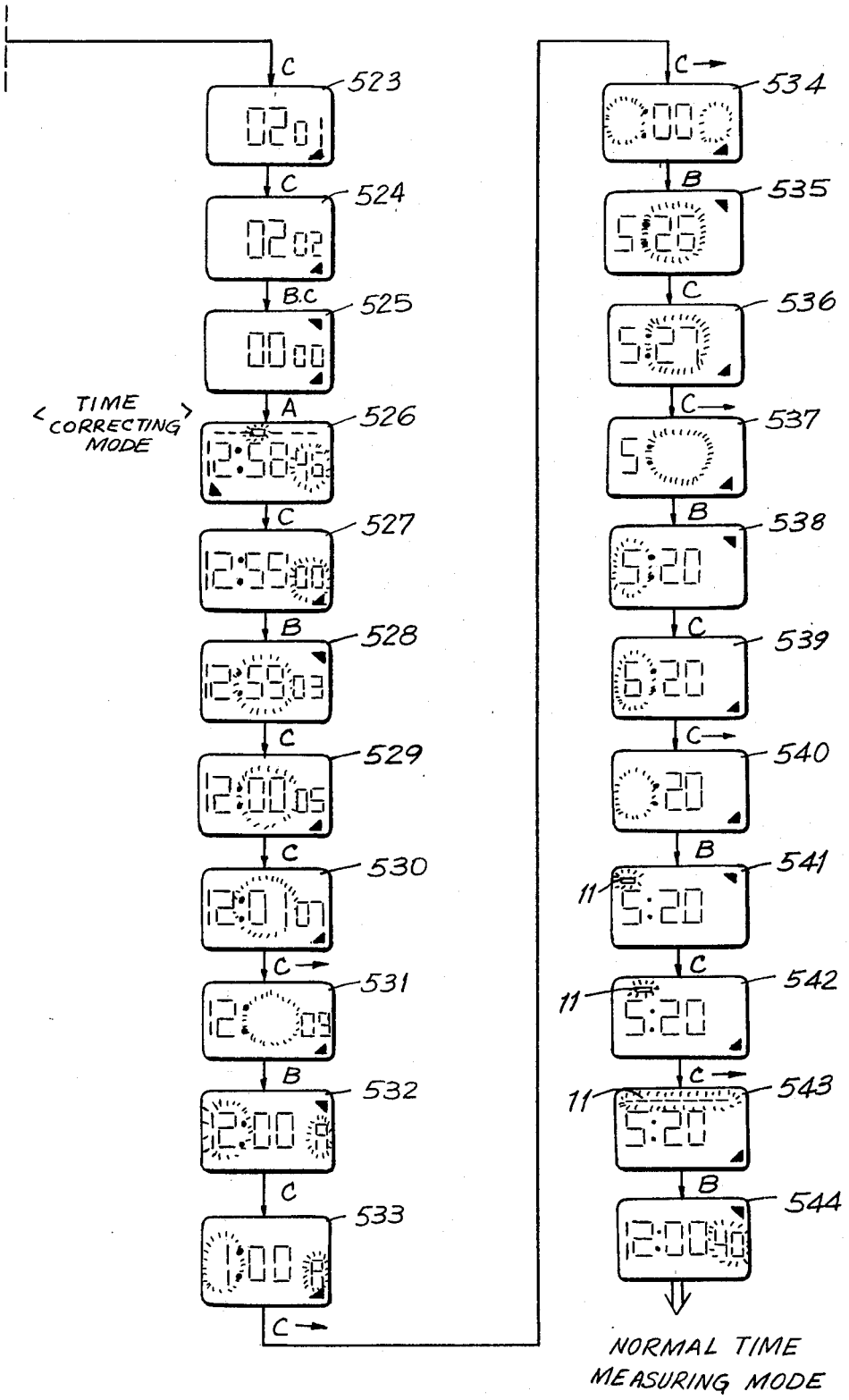

A general description of the circuit construction has been presented above. The demonstration mode occurs as described hereinafter. When the four switches A, B, C and D are simultaneously actuated, that is, turned on, the displays shown in FIG. 5 and indentified by the reference numerals 501 to 544 are produced automatically and successively for demonstration. The first display 501 of the demonstration mode presents arbitrarily selected conditions of time and day as more fully explained hereinafter. Thereafter, displays identified with the reference numerals 503–544 are automatically and successively demonstrated.

In the display 502, the month and date are displayed and the display marker B′ is continuously lit. This indicates that the switch B would be actuated to go from the condition shown in display 501 to the condition shown in the display 502. Note, that this is the same operation which was accomplished in going from condition 200 to condition 201 of FIG. 2 by actuation of the switch B. Thus, illumination of the marker B′ teaches that the month and date display are brought forth by actuation of the B switch. The arrows between the displays 501, 502 identified with a capital letter B is for purposes of illustration and the capital letter B, of course, would not appear on the actual display of the timepiece. The horizontal arrow associated with the letter B indicates an extended actuation of the switch B.

In the display 503, the display marker C′ is continously lit and the alarm set time is displayed. In the display 504, the display markers B′, C′ are lit simultaneously and the alarm sounding mark is also visible. In the display 505, the markers B′ and C′ continue to be lit and the alarm sounding mark flashes. In the display 506, the display markers B′ and C′ are simultaneously visible and the alarm sounding mark is visible but not flashing. Radiating lines are used to denote flashing.

Displays 507–521 comprise the stopwatch mode demonstration. In the display 507, the display marker A′ is visible and the stopwatch mode is produced and the indicator 11 next to STOP WATCH is flashing. Note in FIG. 1 that the words STOP WATCH are printed above the display and on the left where the marker 11 is located. This marker is also used to identify the day in the time measuring mode. In the display 508, the display marker B′ is visible and addition is started in the 1/10 seconds digit of the stopwatch mode and simultaneously the indicator of 1/10 s flashes. In the display 509, the display marker C′ is visible. A lap time is displayed and the addition in 1/10 seconds is continued within the watch while the display remains unchanged. The LAP indicator is also lit and flashing. In the display 510, the display marker C′ is visible and the time additions which occur during the elapsed time of lap display are displayed, that is, the elapsed time in the stopwatch mode is displayed as it would be if the lap reading was omitted. In the display 510, the LAP indicator is not flashing. In the display 511, the display marker B′ is turned on and the display is stopped to display the stop watch mode. The indicator 11 of 1/10 seconds does not flash, but the indicator 11 of STOP is flashing adjacent to the printing of STOP on the face (FIG. 1).

In the display 512, the display marker C′ is lit and the display returns to zero, that is, to the condition 507 which initiated the stopwatch mode, and the STOP indicator stops flashing.

The stopwatch mode is completed with the display 512. It should be noted that each display marker A', B', C', D' on the face which is lit in association with a given display indicates which external switch A, B, C or D is actuated, or which combination is actuated, to produce the display mode which is presented while that marker is illuminated. Thus, every change in the display teaches the user how in actual usage such a mode is produced on the display of the timepiece. Also, as stated above, the indicators 11 which flash in the stopwatch mode alert the user to the printed material on the face of the watch, for example, the labels, ALARM SET, COUNTER, TIME SET. Thus, the indicators 11 serve in a timekeeping mode to indicate the days of the week and in a stopwatch to indicate the various conditions of measuring tenths of seconds, laps, etc.

The alarm time setting mode as it is demonstrated during the demonstration function is indicated by displays 513 to 519 inclusive. In the display 513, the display segment A' is lit and the display shows the alarm time set mode which is similar to the display 210 of the FIG. 2. The indicator 11 adjacent to the printed wording ALARM SET flashes and the hour digits flash to indicate that the hour digit can next be adjusted. In the display 514, the display segment C' is lit and the hour digit is advanced by one unit. In the display 515, the display marker C' continues lit and the hour digit is quickly advanced during that time. In the display 516, the display segment B' is lit, the hour digit no longer flashes and the two digits which indicate minutes begin to flash. In the display 517, the display segment C' is again lit and the one minute digit is advanced by one unit. In the display 518, the display segment C' continues to be lit and the minute digits quickly advance during that time. In the display 519, the display marker B' is lit and the minute digits no longer flash and the hour digit begins to flash again. Thereby, the display is returned to a condition similar to display 513 which initiated the demonstration of the alarm set mode.

This completes the demonstration of the alarm set mode which is followed by a demonstration of the counter mode beginning with the display 520.

In the display 520, marker A' is lit and the display shows that a counter mode is effected. The indicator 11 adjacent the words COUNTER on the face of the watch is flashing and continues to flash until completion of display 525 although it is not illustrated in each panel of FIG. 5. In the display 521, the display marker B' is lit and the digit indicating minutes is advanced by one unit. In the display 522, the display marker B' is again lit and the minute digit is advanced by one more unit. In the display 523, the display marker C' is lit and the second digit is advanced by one unit. The display 524, the display marker C' is again lit and the second digit is again advanced by one unit. In the display 525, both display markers B', C' are simultaneously lit and both the minute digits and the second digits are returned to zero which is similar to the initial demonstration phase 520 of the counter mode.

In the display 526, the display marker A' is lit and a display of the time correcting mode is effected. The seconds digits flash and the indicator 11 adjacent to the printing on the face of the watch, namely, the printing TIME SET, is flashing. The flashing continues until the display 534 although it is not so illustrated on FIG. 5. In the display 527, the display marker C' is lit and the seconds digit are returned to zero. In the display 528, the display marker B' is lit and the minutes digits begin flashing. The second digits are no longer flashing. In the display 529, the display marker C' is lit and the minute digit is advanced by one unit. A carryover from "59" to "00" is illustrated. In the display 530, the display marker C' is again lit and the minute digit is advanced by one more unit. In the display 531, the display marker C' is lit continuously and the minute digits is continuously corrected during that time. In the display 532, the display marker B' is lit. The minutes digits no longer flash and the hour digits are flashing. In the display 533, the display marker C' is lit and the hour digit is advanced by one unit. In the display 534, the display marker C' is lit continuously and the hour digits advance rapidly during that time.

In the display 535, the display marker B' is lit and the month and day are displayed and the date digits are flashing. In the display 536, the display marker C' is lit and the date digit is advanced by one unit. In the display 537, the display marker C' is lit continuously and the date digit is rapidly advanced during that time.

In the display 538, the display marker B' is lit and the month digits flash while the date digits no longer flash. In the display 539, the display marker C' is lit and the month digit is advanced by one unit. In the display 540, the display marker C' is lit continuously and the month digits are quickly advanced during that time.

In the display 541, the display marker B' is lit and the day and month are displayed without flashing. The day indicator 11 flashes adjancent to the marking for Sunday (FIG. 1). In the display 542, the display marker C' is lit and the day indicator 11 flashes adjacent to the marking for Tuesday on the face of the display. In the display 543, the display marker C' is lit continuously and the day indicator 11 which is flashing quickly advances through the days of the week during that time. In the display 544, the display marker B' is lit and the display is returned to the same demonstration condition as shown in the display 526.

After automatically passing through the displays 501 to 544 in sequence, as described above, the demonstration mode is completed and the watch reverts to the normal time display condition. All the capabilities of the timepiece and indications of which switches are to be actuated to effect these functional modes have been demonstrated to the user. The demonstration mode and the functional capabilities of the watch described above have been selected as an example. It should be apparent that other combinations of plural functions can be demonstrated in a similar manner. This ability to demonstrate the functions and provide instructions in the use of the watch by means of this demonstration is highly advantageous not only for the user but also for those persons servicing the timepiece after sale.

A circuit comprising a central processing unit, a random access memory unit and a read-only memory unit may also have the same functions. In such a circuit, the main program is provided to the field of a ROM unit for accomplishing the normal time measuring functions and the sub-program is provided to another field of a ROM unit for accomplishing the contents of the sub-program. Operation is switched from the main program to the sub-program when a special interruption is provided, for example, as described above by the simultaneous actuation of a plurality of switches. When the steps of the sub-program are accomplished, operation is reverted to the main program. When the demonstration function is programmed in the sub-program, the purposes of this invention are implemented. In such a circuit arrangement, it is simple to change the demonstration function by altering the program and the load on the circuit may be reduced.

In summarizing, the demonstration modes of this invention are designed so that not only are all the functions of the watch automatically demonstrated in sequence, but also the manner of operating the external switch members for each mode is demonstrated for each mode.

It will thus be seen that the objects set forth above, among those made apparent from the preceding description, are efficiently attained and, since certain changes may be made in the above contructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic watch having a display unit, means for driving said display unit, and external members, said watch being capable of operation to perform and display a plurality of functions, said performance and display being independently initiated by selective actuation of said external members, the improvement therein comprising:

circuit means for automatically demonstrating by simulation in a sequence at least a portion of said plurality of functions, said simulated demonstrated functions being displayed by said display unit.

2. An electronic watch as claimed in claim 1, wherein said plurality of functions includes a time measuring mode having a divider network and timekeeping circuits.

3. An electronic watch as claimed in claim 1 or 2, wherein said demonstration sequence is initiated by selective actuation of said external members.

4. In an electronic watch having a display unit, means for driving said display unit, and external members, said watch being capable of operation to perform and display a plurality of functions, said performance and display being independently initiated by selective actuation of said external members, the improvement therein comprising:

circuit means for automatically demonstrating by simulation in a sequence at least a portion of said plurality of functions, said simulated demonstrated functions being displayed by said display unit; and a plurality of markers on said display unit, one said marker being positioned on said display unit to be physically adjacent to each external member, at least one of said markers being selectively lit on said display unit during each simulated function in said demonstration sequence, said at least one selectively lit marker indicating the associated external member to be actuated to implement in normal usage the same function as the demonstrated function.

5. An electronic watch as claimed in claim 4, and further comprising circuit means for normally implementing for display said plurality of functions, said circuit means for normal implementation being independent of said circuit means for automatically demonstrating, said selective actuations of said external members determining which of said circuit means provides control signals to said means for driving said display unit.

6. An electronic watch as claimed in claim 4, and further comprising circuit means for normally implementing for display said plurality of functions, said circuit means for normal functioning being independent of said circuit means for automatically demonstrating, said selective actuations of said external members determining which of said circuit means inputs control signals to said means for driving said display unit.

7. An electronic watch as claimed in claim 6, wherein said circuit means for demonstrating include:

a function counter, said function counter being started by said selective switch actuation to begin said demonstration;

means for selecting signals of different frequencies from said divider network, said frequency signals being selected in accordance with the count of said function counter;

a plurality of signal counter means in series accumulating said selected frequency signals, said signal counters having output terminals;

a data latch sensing the output terminals of said signal counters; and a display decoder having outputs for driving said display unit, said data latch inputting the outputs of said signal counters to said display decoder, whereby changes in count of said function counter automatically change the display.

* * * * *